US010357671B2

(12) United States Patent
Müller et al.

(10) Patent No.: US 10,357,671 B2
(45) Date of Patent: Jul. 23, 2019

(54) RESPIRATOR DEVICE

(75) Inventors: Rüdiger Müller, Stockelsdorf (DE); Joachim Schlobohm, Bad Oldesloe (DE)

(73) Assignee: Dräger Safety AG & Co. KGaA, Lübeck (DE)

( * ) Notice: Subject to any disclaimer, the term of this patent is extended or adjusted under 35 U.S.C. 154(b) by 1369 days.

(21) Appl. No.: 13/474,278

(22) Filed: May 17, 2012

(65) Prior Publication Data

US 2012/0298104 A1 Nov. 29, 2012

(30) Foreign Application Priority Data

May 26, 2011 (DE) ..... 10 2011 102 511

(51) Int. Cl.
*A62B 18/08* (2006.01)

(52) U.S. Cl.
CPC ..... *A62B 18/084* (2013.01)

(58) Field of Classification Search
CPC ... A61M 16/0683; A61M 16/06; A62B 17/04; A62B 18/04; A62B 18/084; A62B 18/0683
USPC ..... 128/207.11, 201.23, 206.27
See application file for complete search history.

(56) References Cited

U.S. PATENT DOCUMENTS

| | | | | |
|---|---|---|---|---|
| 2,875,757 | A * | 3/1959 | Galleher, Jr. ..... | A61M 16/0683 128/206.26 |
| 3,624,663 | A * | 11/1971 | Jones ..... | A42B 3/04 128/201.23 |
| 4,024,586 | A * | 5/1977 | Lamb ..... | A42B 3/124 2/414 |
| 5,038,776 | A | 8/1991 | Harrison et al. | |
| 5,431,156 | A * | 7/1995 | Sundstrom ..... | A62B 18/025 128/201.23 |
| 6,691,314 | B1 * | 2/2004 | Grilliot et al. ..... | 2/5 |
| 7,803,028 | B2 * | 9/2010 | Melius ..... | 441/64 |
| 2008/0115788 | A1 * | 5/2008 | Eschen et al. ..... | 128/207.11 |

FOREIGN PATENT DOCUMENTS

| | | | |
|---|---|---|---|
| CN | 201603315 | | 10/2010 |
| DE | 43 04 891 | A1 | 9/1993 |
| DE | 43 04 891 | C2 | 4/1999 |
| GB | 377 926 | A | 8/1932 |
| GB | 2264647 | A | 9/1993 |
| GB | 0800007 | | 7/2009 |
| GB | 2456136 | A | 7/2009 |

* cited by examiner

*Primary Examiner* — Gregory A Anderson
*Assistant Examiner* — Victoria Murphy
(74) *Attorney, Agent, or Firm* — McGlew and Tuttle, P.C.

(57) ABSTRACT

A device for respiration with a half mask (4) and with a strap (6) for pressing the half mask (4) onto the face of a mask user (7). Wearing comfort is facilitated by providing the strap (6) of a one-piece cut made of an elastic material and having at least one four-point connection with straps (9, 10) to the half mask (4).

22 Claims, 5 Drawing Sheets

RESPIRATOR DEVICE

CROSS REFERENCE TO RELATED APPLICATIONS

This application claims the benefit of priority under 35 U.S.C. § 119 of German Patent Application DE 10 2011 102 511.5 filed May 26, 2011, the entire contents of which are incorporated herein by reference.

FIELD OF THE INVENTION

The present invention pertains to a device for respiration, which comprises a mask.

BACKGROUND OF THE INVENTION

A device of this type has become known from DE 43 04 891 C2. A half mask, which is pressed against the mouth and nose by means of a strap extending at the back of the head, is located within a protective hood, which consists of a supple material. A breathing filter, via which the user of the hood is supplied with breathing air, is located at the half mask. The strap comprises individual, elastic straps, which are sewn together and are connected in a punctiform manner to the inside of the hood. The hood is dimensioned such that it accurately fits the heads of persons of different ages and has a window, which consists of a heat-resistant and chemical-resistant material. In case of danger, for example, in a fire, the hood must be pulled over the user's head and the half mask must now be sealingly in contact with the mask user's face. The drawback of the prior-art device is that by fastening the half mask at two opposite points, pressure points may develop on the mask user's face and when the hood is pulled over, the half mask will not be sealingly in contact with the mask user's face.

SUMMARY OF THE INVENTION

A basic object of the present invention is to improve a device of the type described above in terms of wearing comfort.

According to the invention, a device is provided for respiration. The device comprises a mask and a strap for pressing the mask onto the face of a mask user. The strap is formed of a one-piece cut made of an elastic material and having at least one four-point strap to mask connection.

The four-point strap to mask connection may comprise two upper straps and two lower straps. The strap may comprise a middle part and outwardly extending straps defining sets of U-shaped straps extending from the middle part to the at least one four-point strap to mask connection.

The device may advantageously also comprise a hood covering the strap. The hood may include a fastening point fastening the strap on an inside of the hood. A spacer may also be present between the hood and the strap at the fastening point. The spacer may comprise an extension of a connection point of hood material of the hood.

Provisions are made according to the present invention for the strap to consist of a one-piece cut made of an elastic material and at least one four-point connection with the mask, preferably with a half mask. It is especially advantageous here to design the strap such that the straps extending to the half mask are guided both above and under the mask user's ears and tilting motions of the half mask in relation to the mask user's face are avoided as a result. The strap specified according to the present invention is not limited to half masks, but it also covers tools, full masks with hoods, full masks without hoods as well as mouthpieces, which are carried by the mask user.

The strap consists of an elastic textile as a flat object produced with the use of yarns consisting of fibrous materials, for example, natural fibers, or synthetic fibers. For example, knitted fabrics made of inelastic fibers are manufactured for preparation, or a fabric that consists of a mixture of elastic and inelastic fibers, or one that works with an elastic coating of a basic material. Such materials have an elongation of at least 300% in a preferential direction and at least 120% in other directions.

The textile cut is separated from the elastic textile web, for example, by punching. The further functional requirements imposed on the textile cut are determined by the one-piece cut. Good fixation of a respirator product is achieved without adjusting the straps at the mask user's head.

The advantages of this invention are, on the one hand, the easy and comfortable putting on of the respirator product, and, on the other hand, it is achieved hereby that the respirator product will be ready for use in a short time at the user of the device. It is especially advantageous for the user of the device that no adjustments of the strap are needed to achieve secure fit of the respirator product. No disturbing pressure points will develop on the device user's head or face due to the formation of a large-area holding point on the head. Sufficient holding and sealing function is achieved by means of the strap for all head sizes. Thus, it is also possible to use one textile cut for all head sizes. The one-part textile cut can also be used for optimal multiple connection to respirator products, for example, four-point connection to the mask body. The advantage of a four-point connection becomes manifest especially due to the specific distribution of the necessary holding forces of the breathing connection. The flat design is especially suitable for use under helmets for the device user. Disturbing pressure points on the head are avoided here as well. On the whole, this invention contributes to a high level of wearing comfort.

The elastic textile cut is advantageously inserted into a hood body such that a defined distance or radially outward spacing can be set by a spacer in the hood from the surface of the device user's head. Thermal effects from the outside can be markedly reduced hereby for the user of the device because an insulating layer of air is formed due to the spacer.

Exemplary embodiments of device according to the present invention are shown in the drawings and will be explained in more detail below. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
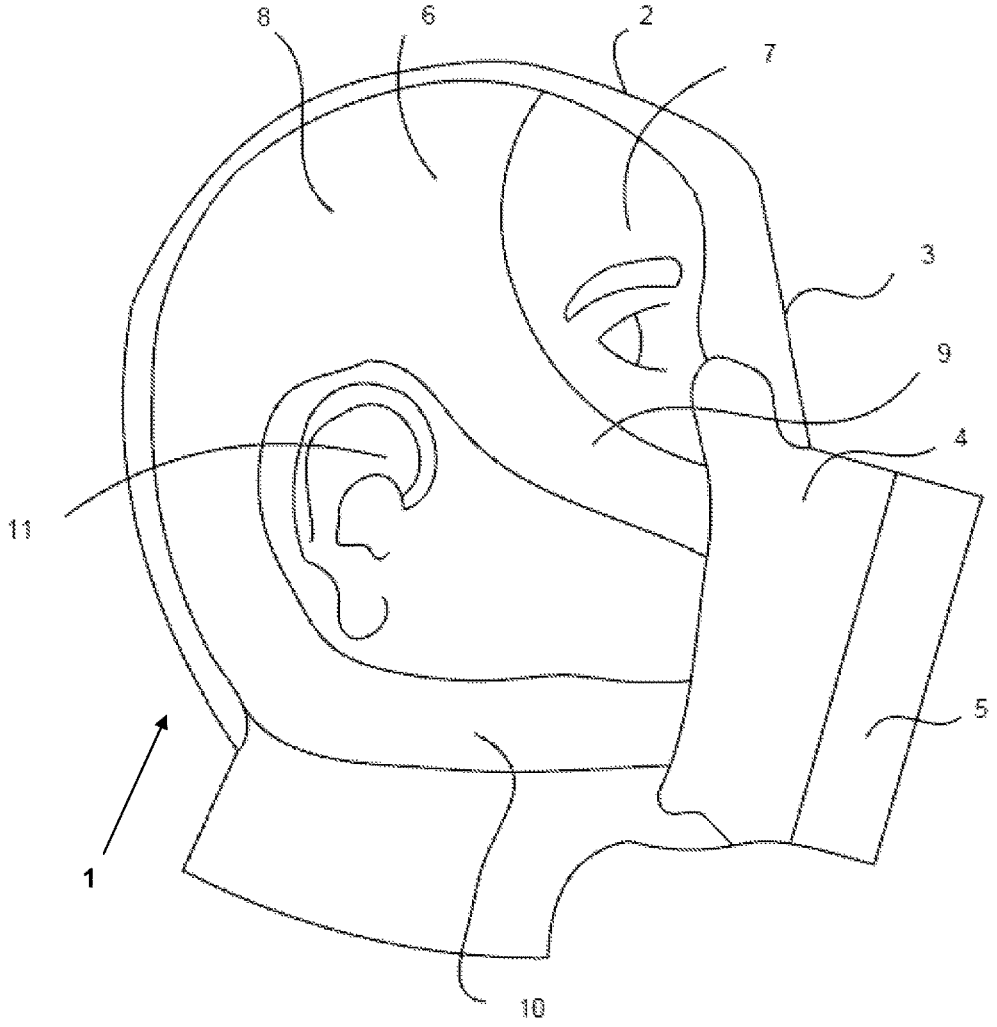
FIG. 1 is a schematic view showing a device for respiration with a hood.

Referring to the drawings in particular, FIG. 1 schematically illustrates a respirator product 1, which comprises a hood 2 with an eye-protecting lens 3, with a half mask 4 arranged within the hood 2, with a filter 5 attached to the half mask 4, and with an elastic strap 6, which extends over the back of the head of the hood user 7, is connected to the half mask 4 and presses same onto the face of the hood user 7. Strap 6 is made in one piece from an elastic material and has a middle part 8 with two upper straps 9 and with two lower straps 10, which extend each in a U-shaped pattern on both sides of the hood user's 7 ears 11 and are connected at the free ends to the half mask 4. Only the right-hand half of the hood user's 7 head is shown in FIG. 1 for the sake of greater clarity.

Figure 2:
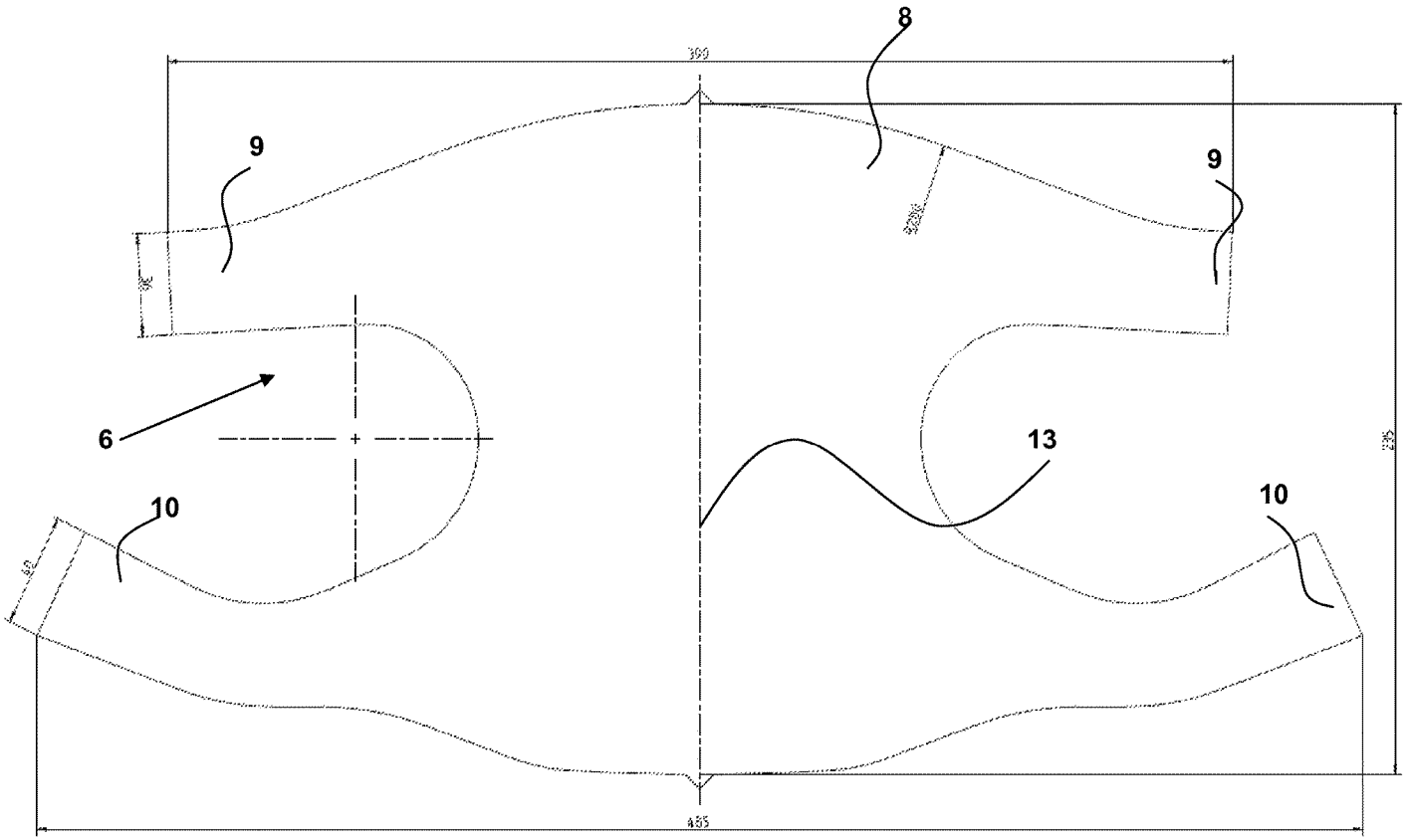
FIG. 2 is a top view showing the cut for a strap without neck closure.

FIG. 2 shows the cut of strap 6. Identical components are designated by the same reference numbers as in FIG. 1. Due to the one-piece design of strap 6, the latter can be prepared in an especially simple manner by punching out a textile web or a knitted tube, as a knitted fabric. Strap 6 is made symmetrical with the center line 13.

Figure 3:
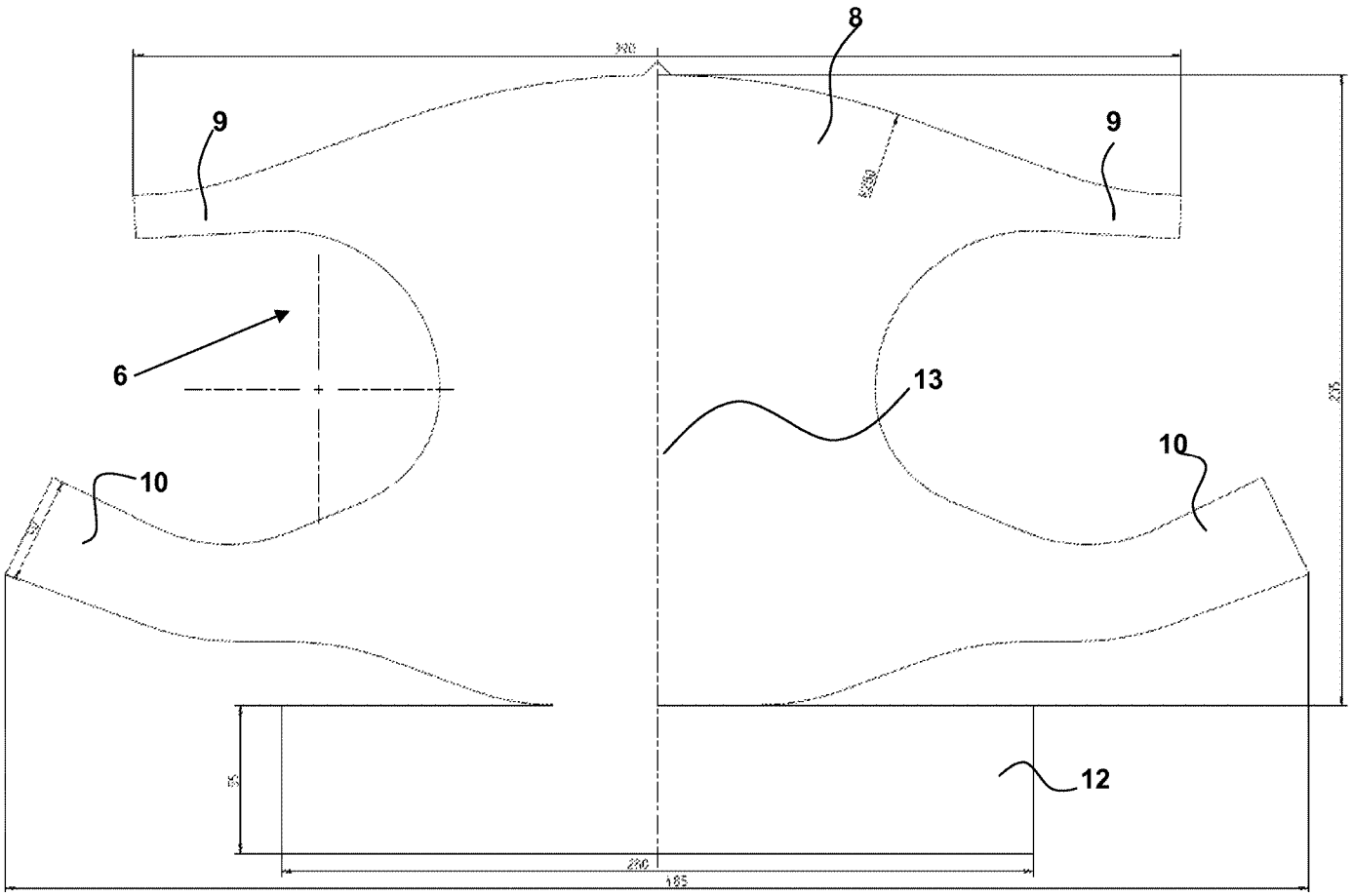
FIG. 3 is a top view showing the cut according to FIG. 2 with neck closure.

Strap 6 according to FIG. 3 is distinguished by the embodiment corresponding to FIG. 2 by an additional neck closure 12. The cut has a width, measured along center line 13, of about 240 mm±20 mm and a length, measured between the free ends of the upper straps 9, of about 390 mm. The width of the upper straps 9 and lower straps 10 equals about 40 mm. With these basic dimensions, strap 6 can be adapted especially well to heads of different shapes and sizes.

Figure 4:
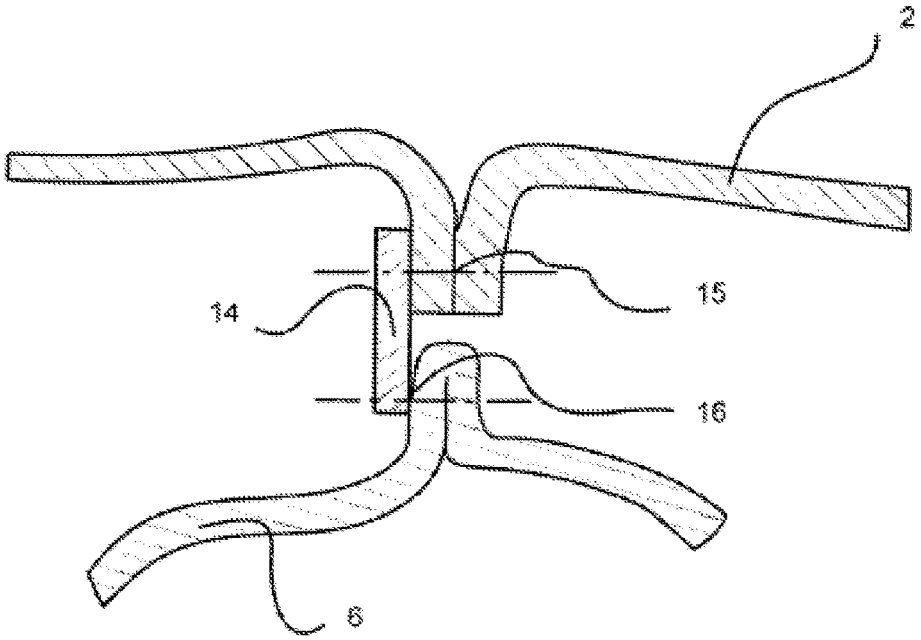
FIG. 4 is a partial sectional view showing a first embodiment with a spacer.
Figure 5:
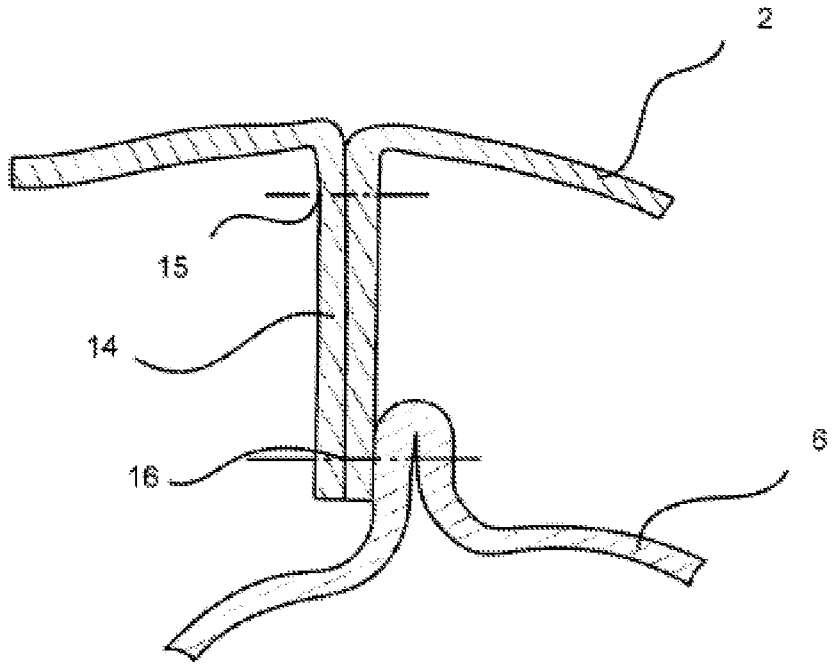
FIG. 5 is a partial sectional view showing a second embodiment with a spacer.

FIG. 4 shows an embodiment with a spacer 14 between a first fastening point 15 on the hood 2 and a second fastening point 16 on the strap 6. The second fastening point 16 is preferably located in the area of center line 13 of strap 6, and the strap 6 is folded over here and connected as a fold to form the second fastening point 16. The strap can be sewn together, welded together or bonded in the area of the fold. The first fastening point 15 is preferably a connection point or seam point in the area of the hood material. Instead of a separate spacer, the seam of the hood material is designed as an extension of the first fastening point 15 as a spacer 14 in an alternative embodiment according to FIG. 5. Both the first fastening point 15 and the second fastening point 16 are located here in the area of the hood material.

While specific embodiments of the invention have been shown and described in detail to illustrate the application of the principles of the invention, it will be understood that the invention may be embodied otherwise without departing from such principles.

APPENDIX

List of Reference Numbers

1 Respirator product
2 Hood
3 Eye-protecting lens
4 Half mask
5 Filter
6 Strap
7 Hood user
8 Middle part
9 Upper straps
10 Lower straps
11 Ears
12 Neck closure
13 Center line
14 Spacer
15 First fastening point, connection point
16 Second fastening point

What is claimed is:

1. A device for respiration, the device comprising:

a mask body;

a strap for pressing said mask body onto the face of a mask body user, said strap being formed of a one-piece cut made of an elastic material and having at least one four-point strap to mask connection with four separate and spaced connection points connecting said strap to said mask body, said strap having a middle part and said at least one four-point strap to mask connection extending from said middle part, said middle part being arranged to press onto a back of a head of the mask body user while said mask body is pressed onto the face of the mask body user, said middle part and said four-point strap to mask connection being arranged so as to be cut from a single sheet of the elastic material as a single piece integral part, said strap having a strap fastening point formed by a fold in said single sheet of elastic material;

a hood adapted to cover said strap and a head of the wearer, said middle part of said strap having said strap fastening point connected to said hood on an inside of said hood, said strap fastening point being positioned spaced from said four-point strap to mask connection, said hood being formed of a supple material; and a spacer present between said hood and said strap at said strap fastening point, said spacer being attached to and arranged at said fold in said single sheet of elastic material of said strap and to said hood to provide an insulating layer of air between said hood and said strap.

2. The device in accordance with claim 1, wherein said four-point strap to mask connection comprises two upper straps and two lower straps;

said strap fastening point is arranged on said middle part between said two upper and lower straps.

3. The device in accordance with claim 2, wherein:

said strap has a centerline arranged along a center of said strap;

said strap includes a neck closure, said two upper straps, said two lower straps and said neck closure separately extend laterally out from said centerline, and separately extend away from said middle part, said neck closure being spaced from said middle part and said straps.

4. The device in accordance with claim 1, wherein outwardly extending straps defining sets of U-shaped straps extend from the middle part to said at least one four-point strap to mask connection;

one of said sets of U-shaped straps is arranged to be on a right side of the head of the wearer, one of said outwardly extending straps of said one set is arranged to be below an ear of the wearer, and another of said outwardly extending straps of said one set being arranged to be between the ear and eye of the wearer on the respective side;

said strap fastening point is arranged on said middle part between said U-shaped straps.

5. The device in accordance with claim 1, wherein said spacer comprises an extension of a connection point of hood material of said hood.

6. The device in accordance with claim 1, wherein said strap consists of an elastic textile material with an elongation of at least 120% in one direction and 300% in another direction.

7. The device in accordance with claim 1, wherein said mask body is a half mask body or a full mask body.

8. The device in accordance with claim 1, wherein:

said strap has a centerline arranged along a center of said strap;

said fastening point is located in an area of said centerline and between four points of said at least one four-point strap to mask connection.

9. A device for respiration, the device comprising:

a mask body;

a strap with a middle part for engaging a head of a wearer of the device and pressing said mask body onto a face of the wearer via four separate strap portions extending from the middle part and terminating in a four-point strap to mask connection, each of said four separate strap portions making a connection to said mask body at a point for a total of four points of connection, said four points of connection being separate and spaced from each other on said mask body, said strap being formed of a single sheet of elastic material with said middle part and said four separate strap portions being arranged so as to be cut from said single sheet of elastic material as a single piece integral part, said strap having a strap fastening location formed by a fold in said single sheet of elastic material;

a hood covering said strap, said hood including a hood fastening location on an inside of said hood and located spaced from said four-point strap to mask connection, said strap fastening location being arranged at said middle portion on said strap between said strap portions, and being spaced from said strap portions, said strap being connected to said hood through said hood and strap fastening locations, said hood being formed of a supple material; and a spacer present between said hood and said strap at said hood and strap fastening locations, said spacer fastening said strap to said hood through said hood fastening locations, said spacer being located between said hood fastening location and said strap fastening location, said spacer being connected to said fold in said single sheet of said strap, said fold and said spacer being arranged to space said hood from said strap.

10. The device in accordance with claim 9, wherein said four strap portions comprise two upper straps and two lower straps;

said strap fastening location is arranged directly between said upper straps and said lower straps, said hood fastening location being on a diametrically opposite side of said spacer than said strap fastening location.

11. The device in accordance with claim 9, wherein said strap portions extend outwardly from said middle part and define two sets of U-shaped straps extending from the middle part to said four-point strap to mask connection;

one of said sets of U-shaped straps is arranged to be on a right side of the head of the wearer, one of said outwardly extending straps of said one set is arranged to be below an ear of the wearer, and another of said outwardly extending straps of said one set being arranged to be between the ear and eye of the wearer on the respective side;

said strap fastening location is arranged between said two sets of U-shaped straps.

12. The device in accordance with claim 9, wherein said spacer comprises an extension of hood material of said hood.

13. The device in accordance with claim 9, wherein said strap consists of an elastic textile material with an elongation of at least 120% in one direction and 300% in another direction.

14. The device in accordance with claim 9, wherein:

said strap has a centerline arranged along a center of said strap;

said hood and strap fastening locations are located in an area of said centerline, said strap includes a neck closure, said strap portions and said neck closure separately extend laterally out from said centerline, and separately extend away from said middle part, said neck closure being spaced from said middle part and said strap portions.

15. The device in accordance with claim 9, wherein:

said strap and said half mask body are arranged to press said middle part onto a back of a head of the wearer, while pressing said mask body onto the face of the wearer.

16. A device for respiration, the device comprising:

a mask body;

a strap with a middle part for engaging a back of a head of a wearer of the device and four separately spaced strap portions extending from the middle part, each of said strap portions terminating in a strap to mask connection, each of said strap to mask connections being separate and spaced from each other on said mask body, said middle part and said strap portions being arranged to press said mask body onto a face of the wearer, said strap with each of said strap portions being formed of a single sheet of elastic material, said strap having a strap fastening location formed by a fold in said single sheet of elastic material;

a hood configured to cover said strap and the head of the wearer, said hood including a hood fastening location on an inside of said hood, said hood fastening location being positioned spaced from said strap portions; and a spacer arranged between said hood and said strap at said hood and strap fastening locations, said spacer being connected to said strap at said fold to radially outwardly space said hood from said strap with respect to the head of the wearer at said hood and strap fastening locations.

17. A device in accordance with claim 16, wherein:

said strap has a centerline arranged along a center of said strap;

said strap fastening location is located in an area of said centerline;

a filter is attached to said mask body;

said hood includes an eye-protecting lens;

said hood has a seam forming said hood fastening location;

said spacer includes said seam, and said spacer with said seam and said fold is arranged to provide an insulating layer of air between said hood and said strap;

said strap consists of an elastic textile material with an elongation of at least 300% in one direction and 120% in another direction;

said hood is formed of a supple material.

18. The device in accordance with claim 16, wherein:

said fold extends radially outward with respect to the head of the wearer, said fold and said spacer together radially outwardly spacing said hood from an area of said strap surrounding said fold.

19. A device in accordance with claim 18, wherein:

said hood includes a seam formed at said hood fastening location, said seam extending radially inward with respect to the head of the wearer, said seam and said spacer together radially inwardly spacing said strap from an area of said hood surrounding said seam;

said fold being one of sewn and bonded together.

20. A device in accordance with claim 16, wherein:

said hood includes a seam formed at said hood fastening location, said seam extending radially inward with respect to the head of the wearer, said seam and said spacer together radially inwardly spacing said strap from an area of said hood surrounding said seam.

21. The device in accordance with claim 20, wherein:

said seam is a plain seam with seam allowances facing radially inward, said seam allowances and said spacer together radially inwardly spacing said strap from said area of said hood surrounding said seam.

22. A device in accordance with claim 20, wherein:

said seam is a plain seam with seam allowances facing radially inward, said seam allowances forming said spacer.

* * * * *